US009022839B2

(12) United States Patent
Colasurdo

(10) Patent No.: US 9,022,839 B2
(45) Date of Patent: May 5, 2015

(54) DART TIP RESTORATION TOOL

(71) Applicant: Timothy M Colasurdo, Ringwood, NJ (US)

(72) Inventor: Timothy M Colasurdo, Ringwood, NJ (US)

( * ) Notice: Subject to any disclaimer, the term of this patent is extended or adjusted under 35 U.S.C. 154(b) by 86 days.

(21) Appl. No.: 13/851,633

(22) Filed: Mar. 27, 2013

(65) Prior Publication Data

US 2014/0295743 A1 Oct. 2, 2014

(51) Int. Cl.

| | |
|---|---|
| ***B24B 19/00*** | (2006.01) |
| ***B24D 15/02*** | (2006.01) |
| ***B24B 19/06*** | (2006.01) |

(52) U.S. Cl.

CPC ..... *B24D 15/02* (2013.01); *B24B 19/06* (2013.01)

(58) Field of Classification Search

CPC ..... B24B 19/16
USPC ..... 451/324, 352
See application file for complete search history.

(56) References Cited

U.S. PATENT DOCUMENTS

| | | | | | |
|---|---|---|---|---|---|
| 1,248,733 | A | * | 12/1917 | Simmons | 144/28.1 |
| 1,378,597 | A | * | 5/1921 | Mayer | 451/246 |
| 2,545,779 | A | * | 3/1951 | Harrison | 144/28.5 |
| 2,613,645 | A | * | 10/1952 | Von Kameniczky | 144/28.11 |
| 2,851,009 | A | * | 9/1958 | Branvold | 144/28.72 |
| 2,920,426 | A | * | 1/1960 | Williams | 451/231 |
| 3,042,003 | A | * | 7/1962 | Cayo | 144/28.1 |
| 3,092,081 | A | * | 6/1963 | Fraser | 451/231 |
| 3,398,773 | A | * | 8/1968 | Dahle | 144/28.1 |
| 3,698,456 | A | * | 10/1972 | Cho | 144/28.11 |
| 4,069,528 | A | | 1/1978 | Newton et al. | |
| 4,124,048 | A | * | 11/1978 | Fischer | 144/28.2 |
| 4,676,028 | A | * | 6/1987 | Kaczmarski et al. | 451/246 |
| 4,879,844 | A | * | 11/1989 | Giles | 451/119 |
| 4,991,355 | A | * | 2/1991 | Giles | 451/211 |
| 5,199,224 | A | * | 4/1993 | Aluotto | 451/320 |
| 5,921,874 | A | | 7/1999 | Stockhamer | |
| 6,306,051 | B1 | * | 10/2001 | Stockhamer | 473/569 |
| 7,182,679 | B2 | | 2/2007 | Scott | |
| 2006/0277816 | A1 | * | 12/2006 | Scott | 43/43.16 |
| 2008/0132154 | A1 | | 6/2008 | Jewett | |
| 2011/0312258 | A1 | | 12/2011 | Scott | |

FOREIGN PATENT DOCUMENTS

| | | | | | |
|---|---|---|---|---|---|
| GB | 2171939 | A | * | 9/1986 | B24B 19/16 |
| GB | 2195565 | A | * | 4/1988 | B24B 19/16 |

* cited by examiner

*Primary Examiner* — Maurina Rachuba
(74) *Attorney, Agent, or Firm* — Ziegler IP Law Group, LLC.

(57) ABSTRACT

A dart restoration tool includes a stator having a conical milling surface and a rotor mounted for rotation about a longitudinal axis of the stator. The rotor includes a guide adapted to accept a tip end portion of a game dart such that the tip end portion engages the conical milling surface. Rotation of the rotor about the longitudinal axis produces an orbital motion of the game dart against the conical milling surface to sharpen the tip end portion of the game dart.

18 Claims, 3 Drawing Sheets

DART TIP RESTORATION TOOL

BACKGROUND

1. Field

The aspects of the present disclosure relate generally to apparatus for restoring the usefulness of a game dart, and more particularly, to an apparatus for sharpening the tip end of a game dart to closely approximate the originally manufactured dimensions.

2. Description of Related Art

The game of darts has been enjoyed for many decades in a variety of recreational, social, and organizational settings. It is generally believed that the game derived its popularity in a military environment wherein, to pass time, solders threw arrows or pointed wood splints at an overturned crate, barrel or felled-section of tree. With respect to the latter, the internal rings of a tree served as convenient markers to tally score while the orientation of tree fibers created natural cracks/openings to capture the tip end of an arrow/dart.

According to many historians, the game of darts was first introduced in pubs and meeting houses of the United Kingdom including the surrounding British Commonwealth. The game was enjoyed by commoners, Nobleman and Royalty alike. While the sport is most popular in the United Kingdom, there are millions of registered clubs world-wide and the sport is quickly becoming an internationally pastime.

A game dart comprises: (1) central barrel providing the forward mass of the dart, (2) a shaft connected to the aft end of the barrel, (3) a fletching attached to the aft end of the shaft to provide aerodynamic stability to the barrel, and (4) a dart tip attached to the forward end of the barrel to penetrate and set the dart into one of the scoring regions of the board. Dart tips generally come in one of at least two lengths, a thirty-two millimeter (32 mm) tip and a forty-one millimeter (41 mm) tip. The points are often knurled and/or coated to improve grip with the dart board. Other tips are designed to retract on impact to absorb impact energy and prevent release of the dart from the board.

In the course of game play, a dart tip can become damaged by striking metallic elements on the board, i.e., various regions of the board which are indicative of a particular point score. For example, the tip may impact a wire surrounding a "triple point" score or "double bull" region. Upon impact, the tip may become deformed, and further damaged upon striking other structures, e.g., the underlying floor.

Repair of damaged tips during the course of play can be important inasmuch as an unrepaired tip may prevent a "winning" throw, i.e., should a dart release from the board. In competition, it is always important to maintain every possible advantage throughout the course of a tournament. Consequently, it is desirable that the dimensions of the tip end of a game dart remain within the specifications established by the Original Equipment Manufacturer (OEM).

There are a variety of dart sharpening apparatus available to the dart enthusiast wishing to maintain his/her game darts at a high level of performance. Unfortunately, each of the prior art dart sharpening apparatus requires intricate set-up and a degree of skill, which, if done incorrectly, can permanently damage the tip end of the dart. Some of the more relevant prior art sharpening apparatus are described below.

Newton U.S. Pat. No. 4,069,528 discloses a tip restoration/sharpening apparatus including an abrasive sharpening means and a straightening member. The sharpening means includes a resilient particulate material having abrasive metal particles suspended in a rubber/resin matrix. The straightening means includes a metal insert having an orifice for accepting a bent tip end of a game dart. An operator uses the orifice of the straightening means, at one end of the device, to straighten a tip, which has been bent, back to its original shape. Subsequently, or alternatively, the operator inserts the tip into an orifice of the sharpening means, at the other end of the device, to abrasively sharpen the tip end. The operator rotates the tip back and forth against the abrasive metal particles to sharpen the tip end. The Newton Patent is subject to operator error and may result in a poorly sharpened tip end.

Aluotto U.S. Pat. No. 5,199,224 is directed to a tool for sharpening a game dart including a planar mill stone, and an apparatus for translating the dart across the mill stone. The apparatus includes: (i) a collet engaging the tip end of a game dart, (ii) a worm gear for translating a block, including the collet/tip end, across the planar mill stone, and (iii) a rack gear for rotating the collet/tip end as the worm gear imparts linear motion to the collet/tip. The Aluotto Patent requires intricate set-up and, similar to the Newton Patent, is subject to operator error.

Martin U.S. Pat. No. 5,951,386 discloses a dart sharpening apparatus having an end cap and a hollow main body member. Within the body member is a self-contained power source and an electrically-operated motor to rotate a honing device mounted within the end cap. Upon pushing a button external to the body member, a conductive strip electrically connects the motor to the battery power source to drive the honing device. The honing device produces a tip which varies in degrees from about twenty-five degrees (25°) to eighty-five degrees (85°). The sharpening apparatus disclosed in the Martin Patent requires a skilled craftsman inasmuch as there is no control over the amount of material removed from the tip during sharpening. Once, again the sharpening apparatus is subject to operator error.

A need, therefore, exists for a dart restoration tool which restores the tip end of a game dart to a "like new" condition, is not subject to operator error, and may be used during the course of game play without fear of damaging the tip of the game dart.

Accordingly, it would be desirable to provide a dart restoration tool that resolves at least some of the difficulties described above.

SUMMARY OF THE INVENTION

As described herein, the exemplary embodiments overcome one or more of the above or other disadvantages known in the art.

According to one aspect of the present disclosure, a dart restoration tool is provided comprising a first member and a second member mounted for rotation relative to the first member. The first member includes a conical milling surface disposed within an annular cavity and defining a longitudinal axis. The second member includes an aperture radially aligned with the annular cavity and adapted to receive a tip end portion of a game dart such that the tip end enters the annular cavity to engage the milling surface. The dart is caused to rotate about the about the longitudinal axis such that the tip end portion is sharpened by the milling surface as the tip end orbits the longitudinal axis.

According to another aspect of the present disclosure, the disclosed embodiments include a dart restoration tool having a stator and a rotor mounted for rotation about the stator. More specifically, the stator includes a conical milling surface defining a longitudinal axis. The rotor includes a guide adapted to accept a tip end portion of a game dart such that the tip end portion engages the conical milling surface of the stator. Rotation of the rotor about the longitudinal axis produces an orbital motion of the game dart against the conical milling surface to sharpen the game dart.

According to yet another aspect of the disclosed embodiments, a dart restoration tool is provided including a stator, a rotor adapted for rotation about the stator, and a journal mount rotationally coupling the rotor to the stator. The stator includes a frustoconical milling stone defining a conical milling surface and a longitudinal axis. The rotor includes a guide adapted to accept a tip end portion of a game dart such that the tip end portion engages the conical milling surface of the stator. Rotation of the rotor about the longitudinal axis produces an orbital motion of the game dart against the conical milling surface to sharpen the tip end portion of the game dart.

DETAILED DESCRIPTION OF THE DISCLOSED EMBODIMENTS

Figure 1:
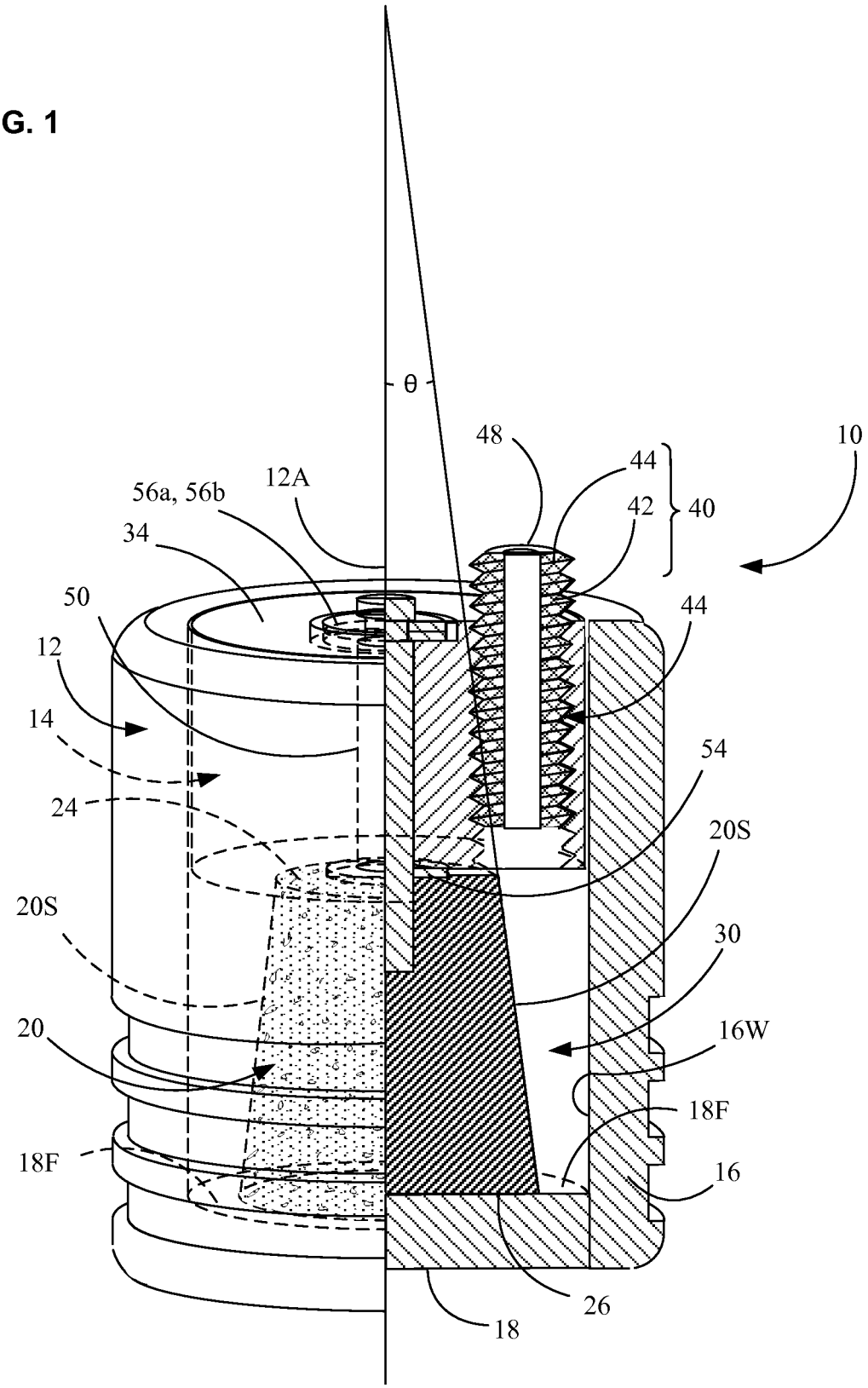
FIG. 1 illustrates a broken-away side perspective view of one embodiment of a dart restoration tool incorporating aspects of the present disclosure.

Referring to FIG. 1, one embodiment of a dart restoration tool incorporating aspects of the present disclosure is generally indicated by reference number 10. The dart restoration tool 10 restores the tip end of a game dart to dimensions which closely approximate the dimensions of the Original Equipment Manufacturer (OEM). Further, inasmuch as the dart restoration tool does not require elaborate set-up, the tool may be used in the course of game play to ensure optimal performance.

The dart restoration tool 10 includes a stator, or first member 12, and a rotor, or second member 14, mounted for rotation about a longitudinal axis 12A defined by the stator 12. The stator 12 includes any element of the tool 10 which is rotationally-fixed or stationary relative to the longitudinal axis 12A while the rotor 14 includes any element which rotates relative to the longitudinal axis 12A. From the following description, the elements which comprise the stator 12 and rotor 14 will be readily identified.

Figure 2:
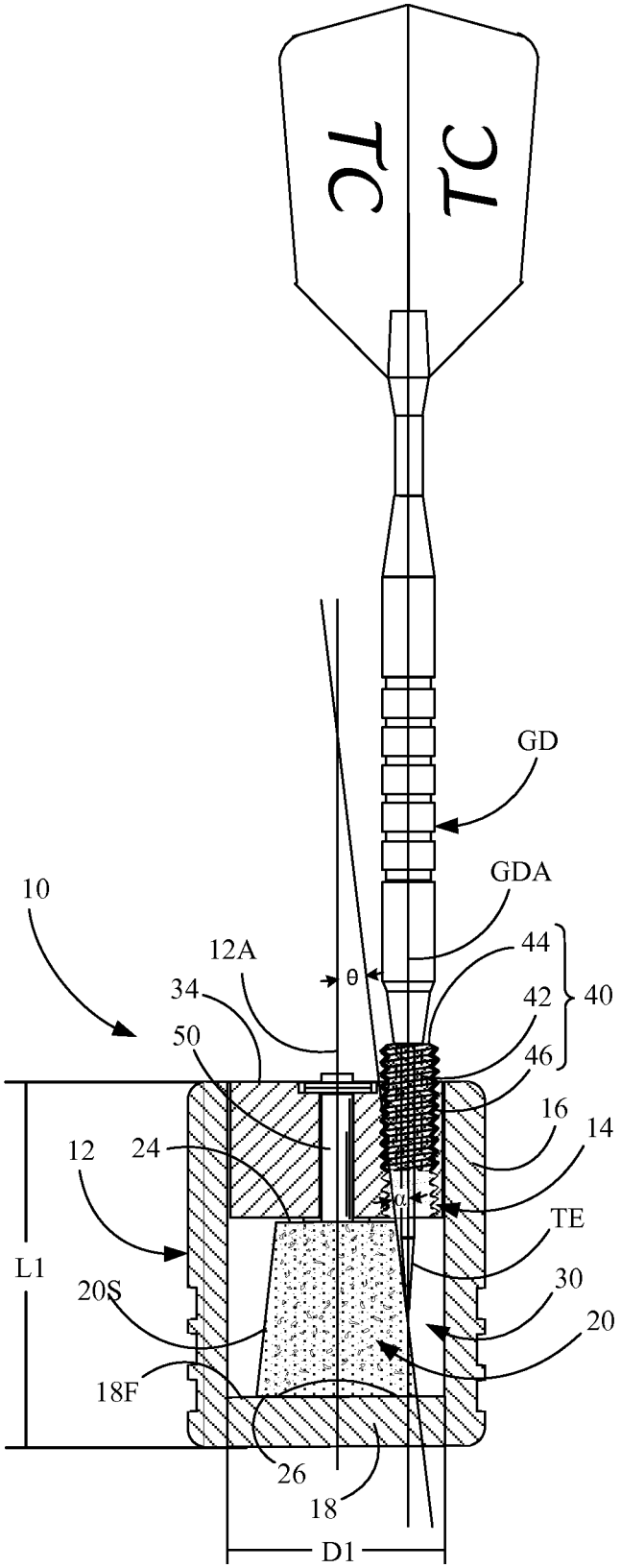
FIG. 2 is a broken-away side view of the dart tip restoration tool depicted in FIG. 1 including a rotor mounted for rotation about a stator, the stator including a conical milling stone and the rotor including a guide adapted to accept a tip end portion of a game dart to guide the tip end portion into frictional engagement with the conical milling stone.
Figure 3:
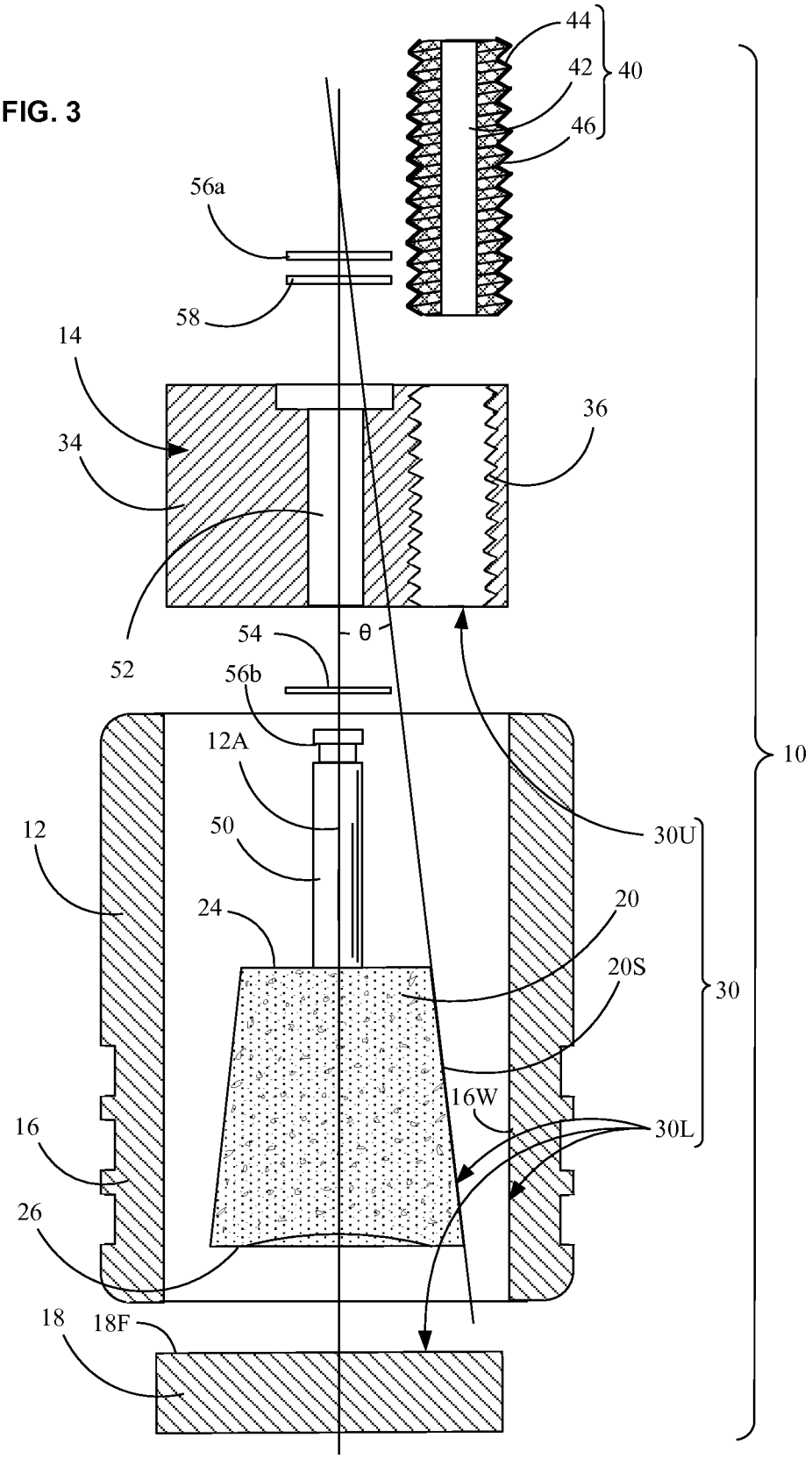
FIG. 3 is an exploded view of the dart tip restoration tool shown in FIG. 2.

In FIGS. 1, 2 and 3, the stator 12 includes a cylindrical outer housing 16 and a base plug 18 (best seen in the exploded view of FIG. 3) which is press fit into the cylindrical housing 16 to close one end of the stator 12. The stator 12 is fabricated such that an operator may grip the cylindrical outer housing 16 in one hand while the other hand is free to manipulate a game dart for sharpening. In the described embodiment, the cylindrical outer housing 16 is: (i) about one and one-half inches (1½") in length L1, (ii) about one inch (1") in diameter (D1), and has a peripheral circumference of about three and one-eighth inches (3⅛").

The stator 12 also includes a conical milling stone 20 affixed to the base plug 18 disposed internally of the cylindrical housing 16. While the conical milling stone 20 may be coupled to the plug 18 by any one of a variety of attachment means, e.g., a threaded screw, bolt, rivet, etc., the milling stone 20 is adhesively bonded to a face surface 18F of the base plug 18 by a plastic-to-steel adhesive epoxy. A suitable adhesive for bonding the milling stone 20 to the metallic base 18 is a two-part adhesive available from ITW Devon under the tradename "S-6 High Strength Plastic Steel Filled Epoxy." ITW Devcon is located in the city of Danvers, State of Mass., USA. In the described embodiment, the milling stone 20 is bonded to the base plug 18 prior to being press fit into the end of the cylindrical outer housing 16, thus providing an opportunity to inspect the bond-line prior to assembly.

The conical milling stone 20 has a milling surface 20S with a medium to fine grit rating of between eighty (80) to about one-hundred and sixty (160). The milling stone 20 employed in the described embodiment has a medium grit rating of one-hundred and twenty (120). The milling stone 20 may be fabricated from conventional abrasive materials such as aluminium oxide, silicon carbide. emery, garnet and flint. In the described embodiment, a conical milling stone 20 of the type described above, i.e., with a one-hundred and twenty (120) grit abrasive surface, is available from McMaster-Carr Industries located in Robbinsville, State of N.J., USA.

The conical milling stone 20 defines a cone angle θ with respect to the longitudinal axis 12A of the stator 12. Restoration is most effective when employing a milling stone having a shallow cone angle, i.e., less than about sixteen degrees (16°), relative to the longitudinal axis 12A. On the other hand, a conical milling stone having a milling surface 20S which is less than about six (6) degrees can develop friction forces which are too high for the intended purpose, i.e., friction sufficiently high to prevent release of an object. Consequently, the conical milling surface 20 provides optimal performance within a range of between about six degrees (6°) to about sixteen degrees (16°).

In the described embodiment, the conical milling stone 20 defines a frustum-shape cone including a major base plane 24 and minor base plane 26 on each side of the conical milling surface 20S. As alluded to earlier, the major base plane 24 is adhesively bonded to the base plug 18 such that the conical milling surface 20S, the base plug 18, and the inner wall 16W of the cylindrical outer housing 16, define a lower portion 30L (see Fig, 3) of an annular cavity 30.

The rotor member 14 includes a rotating disc 34 mounted for rotation to the stator 12 about the longitudinal axis 12A. The rotor disc 34 is disposed in the cylindrical housing 16 and defines an upper portion 30U (FIG. 3) of the annular cavity 30. Accordingly, in the described embodiment, the annular cavity 30 has at least one inclined surface, i.e., defined by the milling surface 20S, which defines a shallow +angle θ, i.e., between six (6°) and sixteen (16°) degrees, relative to the longitudinal axis 12A, The rotor disc 34 includes a guide 40 having an aperture 42 radially aligned with the annular cavity 30. In the described embodiment, the aperture 42 is defined by a threaded insert 44 which engages a threaded aperture 36 of the rotor disc 34. As such, the threaded insert 44 may be raised and lowered within the rotor disc 34, or axially adjusted relative to the conical milling surface 20S. In one embodiment, the threaded insert permits axial adjustment of the game dart while being sharpened. To ensure that the threaded insert 44 is retained within the aperture 36, a motion limiting structure or device may be incorporated to prevent the insert 44 from separating from the rotor disc 34. That is, a motion limiting structure may be incorporated to ensure that the insert will not be lost and disable the usefulness of the dart restoration tool 10.

In one embodiment, the motion limiting structure may include a nylon patch bonded or fused to an end of the insert 44 to prevent the insert 44 from being turned/rotated beyond a predefined axial position. In another embodiment, the aperture 36 of the rotor disc may be modified to include an internal step to be engaged by an outwardly projecting flange formed along an end of the threaded insert 44. In this embodiment, the threaded insert 44 is assembled by engaging the threaded aperture 36 from the underside of the rotor disc 34 such that the flange engages the step of the aperture 36 upon reaching a predefined axial position. The flange of the insert 44 and internal step of the aperture 36 prevents the insert 44 from being lost by falling free/away from the rotor disc 34.

To facilitate axial adjustment, a lubricating film 46 may be disposed between the threaded insert 44 and threaded aperture 36. In the described embodiment, a polytetrafluoroethylene (PTFE) may be disposed between the insert 44 and the aperture 36 to reduce the torque required to rotate the insert 44 within the aperture 36.

In the described embodiment, the rotor disc 34 rotationally mounts to the stator 12 by a journal mount. The journal mount includes a shaft 50 co-axially aligned with the longitudinal axis 12A of the stator 12 and projecting from the minor base plane 24 of the frustum-shaped, i.e., frustoconical, milling stone 20. Further, the journal mount includes a central bore 52 in the rotor disc 34 for accepting the shaft 50, a low friction interface, e.g., at least one washer 54 disposed between the minor base plane 24 and the rotor disc 34, and a retention mechanism, i.e., a clip 56*a* and groove 56*b* disposed within the shaft 50, for axial retention of the disc 34 relative to the shaft 50. In the described embodiment, the low friction interface may also include a second washer 58 disposed between the rotor disc 34 and the clip 56*a*. In the described embodiment, the shaft 50 is embedded in, and bonded to, the frustoconical milling stone 20. However, it should be appreciated that the rotor 14 may be rotationally coupled to the stator 12 by any of a variety of coupling means.

In another embodiment of the present disclosure, the journal mount may be modified to enhance, or eliminate the need for, an axial adjustment mechanism to accommodate tip ends which vary in length. That is, the journal mount may be modified to enhance, or eliminate the need for the threaded insert 44 and threaded aperture 36 of the rotor disc 34. In this embodiment, a resilient member (not shown) may be introduced between the minor base plane of the frustum-shaped conical milling stone 20 and the underside of the rotor disc 34 to: (i) permit axial displacement of the rotor disc 34 relative to the conical milling surface 20S and (ii) provide an opposing axial force (i.e., opposing the axial load introduced by an operator during sharpening). With respect to the latter, the opposing axial force prevents radial binding which can occur when the relative position of the tip end and conical milling surface 20S is not determined by an axial adjustment mechanism, e.g., a threaded insert 44 and threaded aperture 36 described hereinbefore.

Resilient members may include a deformable insert, bellows, coil-spring, Belleville-spring, etc., disposed between the conical milling stone 20 and the rotor disc 34. The axial displacement is introduced by the operator during use, i.e., while sharpening the tip end of a game dart GD. Furthermore, the resilient member provides the opposing axial force, i.e., a force opposing the axial load introduced by the operator, to prevent the radial binding discussed in the preceding paragraph.

During use, an operator inserts the tip end TE (see FIG. 2) of the game dart GD into the guide 40 of the rotor 14. More specifically, the tip end TE is inserted such that the tip end portion TE of a game dart GD enters the annular cavity 30 to frictionally engage the conical milling surface 20S of the milling stone 20. To prevent binding and facilitate grinding/sharpening of the tip end TE, the game dart GD is held parallel to the longitudinal axis 12A of the stator 12 by the aperture 42 of the insert 44. More specifically, the guide 40 accepts the tip end TE of the game dart GD such that the flight axis GDA of the game dart GD defines an angle $\alpha$ which is complimentary to the cone angle $\theta$. A complimentary angle $\alpha$ is produced by the intersection of the conical milling surface 20S with the parallel longitudinal and flight axes 12A, GDA of the stator 12 and game dart GD, respectively.

Inasmuch as all game darts GD are not identical and differ in tip length, i.e., the difference between darts having a thirty-two millimeter (32 mm) tip and a forty-one millimeter (41 mm) tip, the guide 40 may be axially adjusted to bring the tip end TE into frictional engagement with the conical milling surface 20S. As such, the resultant load, i.e., the radial and axial loads, being applied to the tip end TE can be properly limited. While the guide 40 is sized to be adjustable between at least two positions, i.e., between tips which are either thirty-two or forty-one millimeters in length, it will be appreciated that the guide 40 may be axially adjusted to any length to accommodate differences resulting from tip end sharpening over the course of time. Markers (not shown in the figures) may be applied to, or engraved on, the exterior surface of the threaded insert 44 to indicate the axial position of games darts GD of the various standardized game darts GD.

Embodiments incorporating a resilient member between the conical milling stone 20 and the rotor disc 34 may not require any additional adjustment inasmuch as the resilient member accommodates axial displacement of the rotor disc and the tip end portion of the game dart relative to the conical milling surface 20S. Furthermore, as mentioned above, the resilient member provides an opposing axial force to mitigate radial binding of the tip end portion of the game dart GD during sharpening operations.

Depending upon the configuration and/or manufacture of the game dart GD, the bearing surface 48 engages an upper end of the barrel BR, or a tooling surface of the tip end TE, to limit the load which can be applied to the tip end by the milling surface 20S. The operator rotates the game dart GD about the rotational axis 12A thereby effecting an orbital motion to the tip end TE of the game dart GD relative to the conical milling stone 20.

In summary, an inventive dart restoration tool 10 is provided including a rotor 14 mounted for rotation to a stator 12 about a longitudinal axis. The stator 12 houses a conical milling stone 20 which includes a conical milling surface 20S operative to frictionally engage the tip end portion of the game dart. The tip end portion of the game dart sits within a guide of the rotor and is rotated about the longitudinal axis such that the tip end of the game dart GD orbits about the conical milling stone 20 to sharpen the game dart GD about its longitudinal flight axis, i.e., evenly on all sides of the game dart. The dart restoration tool sharpens the tip end to its originally manufactured dimensions. Furthermore, the dart restoration tool performs sharpening operations during game play without requiring sophisticated or laborious set-up.

Thus, while there have been shown, described and pointed out, fundamental novel features of the present disclosure as applied to the exemplary embodiments thereof, it will be understood that various omissions and substitutions and changes in the form and details of devices and methods illustrated, and in their operation, may be made by those skilled in the art without departing from the spirit and scope of the aspects of the present disclosure. Moreover, it is expressly intended that all combinations of those elements and/or method steps, which perform substantially the same function in substantially the same way to achieve the same results, are within the scope of the present disclosure. Moreover, it should be recognized that structures and/or elements and/or method steps shown and/or described in connection with any disclosed form or embodiment of the present disclosure may be incorporated in any other disclosed or described or suggested form or embodiment as a general matter of design choice. It is the intention, therefore, to be limited only as indicated by the scope of the claims appended hereto.

What is claimed is:

1. A dart restoration tool for restoring a tip end portion of a dart, comprising:

a first member defining a longitudinal axis and having an annular cavity, a wall of the annular cavity defined by a milling surface of a conical milling stone; and a rotor disc centered on the longitudinal axis and mounted for rotation to the first member about the longitudinal axis and defining an aperture radially aligned with the annular cavity, the aperture of the rotor disc being defined by a threaded insert engaging a threaded aperture of the rotor disc, the threaded insert configured to receive the tip end portion of the dart such that the tip end enters the annular cavity to engage the milling surface, wherein the dart is caused to rotate about the longitudinal axis such that the tip end portion of the dart is sharpened by the milling surface, the threaded insert maintaining the dart parallel to the longitudinal axis and permitting axial adjustment of the dart while being sharpened.

2. The dart restoration tool according to claim 1 wherein the tip end of the dart defines an axis, and wherein the axis is substantially parallel to the longitudinal axis of the first member while being sharpened.

3. The dart restoration tool according to claim 2 wherein the conical milling surface defines a cone angle θ, wherein axis defines an angle α which is complementary to the cone angle θ, and wherein the cone angle θ is greater than about six degrees (6°) and less than about sixteen degrees (16°).

4. The dart restoration tool according to claim 1 wherein a lubricating film interposes the threaded insert and the threaded aperture for reducing the torque required to rotate the threaded insert.

5. The dart restoration tool according to claim 1 wherein the milling surface of the conical milling stone is defined by a frustum-shaped milling stone defining a minor base plane and a major base plane, and further comprising a journal mount for rotationally coupling the first member to the second member, the journal mount comprising:

a shaft affixed to the frustum-shaped milling stone along the longitudinal axis and projecting from the minor base plane of the frustum, the shaft disposed within a central bore of the rotor disc.

6. A hand-held dart restoration tool, comprising:

a stator having a conical milling stone with a conical milling surface and defining a longitudinal axis;

a rotor mounted for rotation about the longitudinal axis of the stator, the rotor including a rotor disc centered about the longitudinal axis and having a threaded aperture;

the stator defined by a cylindrical housing, one end of the cylindrical housing including a removable base plug member;

a minor base plane of the conical milling stone coupled to the removable base plug member;

a major base plane of the conical milling stone resiliently coupled to the rotor disc, a low friction resilient member disposed between and forming an interface between the major base plane of the conical milling stone and the rotor disc, a threaded guide engaging the threaded aperture and configured to accept a tip end portion of a game dart such that the tip end portion engages the conical milling surface, wherein rotation of the rotor about the longitudinal axis produces an orbital motion of the game dart against the conical milling surface to sharpen the tip end portion of the game dart.

7. The hand-held dart restoration tool according to claim 6 wherein the tip end of the dart defines an axis, and wherein the axis is substantially parallel to the longitudinal axis of the stator while being sharpened.

8. The hand-held dart restoration tool according to claim 7 wherein the conical milling surface defines a cone angle θ, wherein axis defines an angle α which is complementary to the cone angle θ, and wherein the cone angle θ is less than about sixteen degrees (16°).

9. The hand-held dart restoration tool according to claim 8 wherein conical milling surface defines a cone angle θ which is greater than about six degrees (6°).

10. The hand-held dart restoration tool according to claim 6 wherein a lubricating film interposes the threaded insert and the threaded aperture for reducing the torque required to rotate the threaded insert.

11. The hand-held dart restoration tool according to claim 10 wherein the conical milling surface is of the conical milling stone defined by a frustum-shaped milling stone defining the minor base plane and the major base plane; and further comprising a journal mount for rotationally coupling the rotor to the stator, the journal mount comprising:

a shaft affixed to the frustum-shaped milling stone along the longitudinal axis and projecting from the minor base plane of the frustum, the shaft disposed within a central bore of the rotor disc.

12. A dart restoration tool, comprising:

a stator including a cylindrical outer housing and a base plug closing an end of the cylindrical outer housing, a frustoconical milling stone fixedly disposed within the cylindrical outer housing and affixed to the base plug of the cylindrical housing, the frustoconical milling stone defining a conical milling surface disposed between major and minor base planes, a longitudinal axis, and a cone angle θ relative to the longitudinal axis that is greater than about six degrees (6°) and less than about sixteen (16°), the frustoconical milling stone, cylindrical housing and base plug defining a lower portion of an annular cavity;

a rotor including a rotor disc centered and mounted for rotation relative to the stator about the longitudinal axis, the rotor disc being disposed within an interior upper portion of the cylindrical outer housing above the frustoconical milling stone and defining an upper portion of the annular cavity, the rotor disc including a guide having an aperture radially aligned with the annular cavity for accepting a tip end portion of a game dart such that the tip end portion enters the annular cavity to frictionally engage the conical milling surface of the milling stone; and a journal mount for rotationally coupling the rotor to the stator, the journal mount including the rotor disc having a central bore, a shaft co-axially aligned with the longitudinal axis and projecting from the minor base plane of the frustoconical milling stone, the central bore accepting the shaft for rotation of the rotor disc relative to the shaft, a washer effecting a low friction interface between the minor base plane of the frustoconical milling stone and the rotor disc, and a retention clip for axial retention of the disc relative to the shaft;

wherein upon insertion of the tip end of the game dart into the aperture, the tip end portion is rotated about the longitudinal axis to effect an orbital motion of the tip end relative to, and against, the conical milling surface to sharpen the tip end portion of the game dart.

13. The dart restoration tool according to claim 12 wherein the tip end of the dart defines an axis, and wherein a flight axis is substantially parallel to the longitudinal axis of the stator while being sharpened.

14. The dart restoration tool according to claim 12 wherein the guide of the rotor is defined by a threaded insert engaging a threaded aperture of the rotor disc, the threaded insert permitting axial adjustment of the game dart while being sharpened.

15. The dart restoration tool according to claim 14 wherein a lubricating film interposes the threaded insert and the threaded aperture for reducing the torque required to rotate the threaded insert.

16. The dart restoration tool according to claim 1, comprising a base plug at one end of the first member;

a wide end of the conical milling stone being affixed to the base plug, and an other end of the conical milling stone extending into the annular cavity towards the rotor disc.

17. The dart restoration tool according to claim 16, comprising a resilient member between the rotor disc and the other end of the conical milling stone opposite the wide end of the conical milling stone affixed to the base plug.

18. The dart restoration tool according to claim 1, wherein the dart restoration tool is a hand-held dart sharpener, the first member comprising a gripping surface on a cylindrical outer housing of the first member.

* * * * *